US009937368B2

(12) United States Patent
Qiang et al.

(10) Patent No.: US 9,937,368 B2
(45) **Date of Patent: *Apr. 10, 2018**

(54) INNER CYLINDER OF EXPLOSION-VENTING-TYPE AEROSOL FIRE EXTINGUISHING DEVICE

(75) Inventors: Jian Qiang, Shaanxi (CN); Zhengjun Lei, Shaanxi (CN)

(73) Assignee: XI'AN WESTPEACE FIRE TECHNOLOGY CO., LTD, Shaanxi (CN)

( * ) Notice: Subject to any disclaimer, the term of this patent is extended or adjusted under 35 U.S.C. 154(b) by 258 days.

This patent is subject to a terminal disclaimer.

(21) Appl. No.: 14/239,358

(22) PCT Filed: Aug. 15, 2012

(86) PCT No.: PCT/CN2012/080184

§ 371 (c)(1),
(2), (4) Date: Feb. 18, 2014

(87) PCT Pub. No.: WO2013/023601

PCT Pub. Date: Feb. 21, 2013

(65) Prior Publication Data

US 2014/0190710 A1 Jul. 10, 2014

(30) Foreign Application Priority Data

Aug. 16, 2011 (CN) ..... 2011 1 0244667

(51) Int. Cl.
*A62C 19/00* (2006.01)
*A62C 13/22* (2006.01)
*A62C 5/00* (2006.01)

(52) U.S. Cl.
CPC ..... *A62C 19/00* (2013.01); *A62C 13/22* (2013.01); *A62C 5/006* (2013.01)

(58) Field of Classification Search
CPC ..... A62C 13/64; A62C 13/22; A62C 13/003; A62C 5/006; A62C 19/00
(Continued)

(56) References Cited

U.S. PATENT DOCUMENTS 9,248,328 B2 * 2/2016 Qiang ..... A62C 19/00
2006/0086099 A1 4/2006 Dickerson et al.
(Continued)

FOREIGN PATENT DOCUMENTS

CN 2395749 Y 9/2000
WO WO2011091652 * 4/2011 ..... A62C 5/00

OTHER PUBLICATIONS

International Search Report for corresponding application PCT/CN2012/080184 filed Aug. 15, 2012, dated Nov. 29, 2012.

*Primary Examiner* — Arthur O Hall
*Assistant Examiner* — Christopher R Dandridge
(74) *Attorney, Agent, or Firm* — Cantor Colburn LLP

(57) ABSTRACT

The present disclosure relates to an inner cylinder of an explosion-venting-type aerosol fire extinguishing device, including a cylinder body (3) and a cylinder cover component (4) arranged on one end of the cylinder body (3), and an explosion-venting device arranged on the cylinder body (3). The explosion-venting device includes a friction layer (11), a connecting rod (12), a guiding unit (13), and a limiting device (14). The connecting rod (12) are connected with the cylinder cover component (4). The friction layer (11) is provided between the connecting rod (12) and the cylinder body (3). The friction layer (11) provides a frictional resistance and a buffering force for the connecting rod (12) when the connecting rod (12) is displaced, under the guidance of the guiding unit (13), along a direction that a hot air stream of the cylinder body (3) is jetting towards. The guiding unit (13) is a device capable of providing guidance for the connecting rod (12) when the connecting rod (12) is
(Continued)

moving. The limiting device (14), the cylinder cover component (4), and the connecting rod (12) are fixedly connected. The limiting device (14) limits the connecting rod (12) when an extremity thereof slides to the cylinder cover component (4). The present disclosure uses primarily the movement and limiting of the explosion-venting device to consume kinetic energy generated by deflagration, thus achieving the goal of safe and effective explosion ventilation, and preventing a grain (7) from causing injuries and damages when deflagrated.

3 Claims, 2 Drawing Sheets

(58) Field of Classification Search
USPC ..... 169/30, 75, 77, 78, 84
See application file for complete search history.

(56) References Cited

U.S. PATENT DOCUMENTS

2010/0116515 A1* 5/2010 Felten ..... A62C 13/72
169/71
2014/0175781 A1* 6/2014 Schreiber ..... B60R 22/4633
280/806

* cited by examiner

INNER CYLINDER OF EXPLOSION-VENTING-TYPE AEROSOL FIRE EXTINGUISHING DEVICE

TECHNICAL FIELD OF THE INVENTION

The present invention relates to the field of fire fighting and extinguishing technologies, and more particularly to an aerosol fire extinguishing device capable of anti-explosion, venting pressure and reducing a recoil force.

BACKGROUND OF THE INVENTION

Generally, an existing aerosol fire extinguishing device mainly includes an inner cylinder body, a cylinder cover component arranged on the cylinder body, and an ignition composition coated by a thermal insulation material, an ignition head, a coolant and a ceramic chip etc. arranged in the inner cylinder body in turn. Normally, after the ignition head ignites the ignition composition, a great amount of aerosol smoke is generated by a relatively fast stratified combustion of a grain. These high temperature aerosols are cooled by a coolant layer and then spouted out by a spout of the cylinder cover component to act on a fire source directly to suppress a fire. However, a coating defect, a pyrotechnic grain crack or a serious blockage of a gas channel may lead to a sudden rise of the pressure in the cylinder body to deflagrate the grain. A gas with an ultra-high pressure which is increased quickly is vented forward rapidly to thrust the spout aside and strike the nozzle out at an extremely high speed, thus causing a very large recoil force. The powerful recoil force drives the cylinder body to move backwards rapidly, which is very easy to cause a serious injury to an operator. At the same time, after explosion ventilation, a hot air stream will be accumulated in the cylinder body, and the inner cylinder cover component etc. of the aerosol fire extinguishing device will also disengage with the cylinder body at an extremely high speed and fly outwards for a relatively long distance, which may cause other accidents or even more serious accidents, such as an explosion of the cylinder body of the inner cylinder, and the like when an accumulated pressure is too high.

However, almost all inner cylinder bodies of existing aerosol fire extinguishing devices lack of explosion ventilation (prevention) measures. A method of pressing a front cover tightly is applied at most, which cannot vent explosion safely and still fails to solve the problems above. Therefore, all inner cylinder bodies of the existing aerosol fire extinguishing devices have potential safety hazards to great personal injuries or material damages caused by a powerful recoil force generated after deflagration of an composition, an explosion of a cylinder body and detachment of an inner cylinder cover component.

SUMMARY OF THE INVENTION

To solve the problem of potential safety hazards to personal injuries or material damages caused by a recoil force generated after deflagration of a grain, an explosion of a cylinder body thereof or detachment of a component due to the lack of any explosion prevention and pressure venting measures for an aerosol fire extinguishing device in the prior art, the present invention provides an inner cylinder of an explosion-venting-type aerosol fire extinguishing device.

A technical means applied by the present invention is that:

An inner cylinder of an explosion-venting-type aerosol fire extinguishing device, comprising: a cylinder body 3 and a cylinder cover component 4 arranged on one end of the cylinder body 3, wherein an explosion-venting device is also arranged on the cylinder body 3; the explosion-venting device comprises: a connecting rod 12, a guiding unit 13, and a limiting device 14, the connecting rod 12 are connected with the cylinder cover component 4; the guiding unit 13 is a device capable of providing guidance for the connecting rod 12 when the connecting rod 12 is moving; the limiting device 14 is a device capable of fixing the connecting rod 12 and capable of limiting the connecting rod 12 when an extremity of the connecting rod 12 slides to the cylinder cover component 4. During a process in which the cylinder cover component 4 is separated from the limiting device 14 and slides forwards, a original high pressure gas in the cylinder body will be dispersed rapidly because of expansion of an outlet (venting pressure outlet), and will be consumed and transferred through a physical process so as to be a vent explosion, i.e. the process in which the cylinder cover component 4 slides forwards is an explosion-venting process of the cylinder body 3.

The explosion-venting device further comprises a friction layer 11; the friction layer 11 is provided between the connecting rod 12 and the cylinder body 3; the friction layer 11 provides a frictional resistance and a buffering force for the connecting rod 12 when the connecting rod 12 is displaced, under the guidance of the guiding unit 13, along a direction towards which a hot air stream of the cylinder body 3 is jetting.

The guiding unit may be a guiding ring 15 fixedly connected with the connecting rod 12, or may be also a guiding groove or a slide rail provided on an outer wall of the cylinder body 3 and capable of making the connecting rod 12 slide axially along the guiding groove, or other structures having a guiding function.

The limiting device 14 mainly includes a flanging 16 fixedly connected with the cylinder body 3 and a clamping claw 17 for fixing the connecting rod 12, or a structure as long as the structure can fix the connecting rod 12 on one hand and stop the connecting rod 12 from being separated from the cylinder body 3 on the other hand, wherein the flanging 16 may be integrated with the cylinder body 3 to reinforce the structure thereof and effectively stop an extremity of the connecting rod 12 from being separated from the cylinder body 3; a buffer 18 is further arranged between the flanging 16 and the guiding ring 15 mainly to buffer a collision force between the extremity of the connecting rod 12 and the cylinder body 3 or a collision force between the extremity of the connecting rod 2 and the flanging 16 so as to prolong a collision process while consuming, by releasing elastic energy, a part of kinetic energy generated after a deflagration.

The connecting rod 12 may be further fixedly connected with the cylinder cover component 4 or integrated with the cylinder cover component 4, thus effectively preventing the cylinder cover component 4 from flying outwards to prevent other accidents caused thereby.

The displacement of the connecting rod 12 of the present invention is ranged from 30 mm to 80 mm, preferably 50 mm to 60 mm. A displacement which is too large cannot reduce a recoil force. However, if a displacement is too small, the kinetic energy cannot be consumed thoroughly and the cylinder cover component is very likely to get rid of the blockage of the limiting device 14. Once the cylinder cover component is separated from the cylinder body, a powerful recoil force will be generated. Therefore, appropriate displacement control is of great importance. However, the displacement of the connecting rod 12 may be adjusted appropriately according to a specific application environment, as long as an optimal effect can be achieved.

A spout of the cylinder cover component 4 is sealed by a rubber plug 10 to be sealed against moisture.

A sealing ring 9 is arranged on the junction of the cylinder cover component 4 and the cylinder body 3. The section of the sealing ring 9 is circular, thus reducing cost and improving the sealing effect.

The deflagration of the present invention means that a pyrotechnic grain, which is cracked or broken or has an ineffective external coating, is ignited to burn heavily within an extremely short period of time that is only about 1/10 of normal stratified combustion. After the deflagration of the grain, a great deal of high pressure and high temperature gases will be generated instantaneously.

The working principle of the present invention is that: when the grain 7 is deflagrated, the gas pressure in the grain will increase suddenly and rapidly and the rubber plug 10 on the cylinder cover component 4 will be thrust apart easily by a high pressure gas. Hence, pressure relief of the gas begins. However, there is no time for a normal spout to vent the pressure because of the deflagration, and pressure in the cylinder body 3 will be accumulated to form a high pressure gas. The high pressure gas will thrust apart the clamping claw 7 which is originally bent with 90 degrees and used for tightly clamping the connecting rod 12 and the cylinder body 3. Thus the clamping claw 17 is loosened and thrust apart and the cylinder cover component 4 will be separated from the cylinder body 3 and slide outside. When the clamping claw 17 is loosened and thrust apart, the potential energy of deformation of the clamping claw is overcome by explosive energy, which inevitably consumes a part of the explosive energy (first method of explosion ventilation and energy consumption). Subsequently, the cylinder cover component 4 that has slid outside drives the connecting rod 12 and the guiding ring 15 to slide along an axis of a cylinder wall. In this process, because of the friction layer 11, a relatively large frictional resistance will be generated during the process of the cylinder cover component 4 and the guiding ring 15 sliding on the outer wall of the cylinder body 3, thus consuming a part of kinetic energy of an forward impact of the cylinder cover component 4 (second method of explosion ventilation and energy consumption). When the guiding ring 15 and the cylinder cover component 4 slide forward to the vicinity of a top edge of the inner cylinder body 3, the buffer 18 will be squeezed by the guiding ring 15 and the flanging 16 arranged on and the cylinder body 3 so as to absorb a part of the kinetic energy (third method of explosion ventilation and energy consumption). When the two parts slides oppositely to squeeze the buffer 18 to the limit so that the buffer 18 cannot be squeezed any more, the buffer 18 will react upon the two objects which are close oppositely and a part of stored elastic potential energy will be released so as to further stop the two objects from getting closer. Therefore, a part of kinetic energy is also consumed (fourth method of explosion ventilation and energy consumption). Finally, a front end of the guiding ring 15 is collided on the flanging 16 on the inner cylinder body 3, and partial elastic or plastic deformation of the flanging 16 can also effectively stop a front cover and a sliding ring from moving forwards (fifth method of explosion ventilation and energy consumption). Thus, the energy generated by the whole deflagration is almost exhausted, and the connecting rod and the front end stops displacement. Therefore, there will be no relatively large recoil force acting on the cylinder body 3, and the danger that the cylinder cover component 4 is thrust outwards can be effectively prevented. During the process in which the cylinder cover component 4 is separated from the limiting device 14 and slides forwards, the original high pressure gas in the cylinder body will be dispersed or consumed rapidly because of the expansion of the outlet (venting pressure outlet), i.e. the process that the cylinder cover component 4 slides forwards is a venting pressure process of the cylinder body, thus preventing an danger of the explosion of the whole body or the flying-separation of an component, and the limited displacement of the connecting rod, i.e. the final limitation, is to reduce the recoil force and prevent injuries and damages caused by the generated recoil force.

The present invention is an inner cylinder of an explosion-venting-type aerosol fire extinguishing device having the following main advantages:

1. the present invention, an explosion-venting device is further arranged on an inner cylinder body, which consumes and relieves a recoil force or a forward impact force generated after a deflagration of an composition mainly through consuming kinetic energy, generated by the deflagration during a moving and limiting process of the explosion-venting device, so as to avoid injuries or damages generated after the deflagration of a gain;

2. a connecting rod of the present invention is connected with a cylinder cover component, a flanging and a clamping claw structure are applied, thus effectively controlling a movement of the connecting rod. The structure can effectively prevent a powerful impact force from acting on the cylinder cover component to thrust the cylinder cover component out of a cylinder body, thus preventing an accident caused by the cylinder cover component after the cylinder cover component flies outwards;

3. a flanging of a limiting device and the inner cylinder body of the present invention are integrated so that the structure is firmer with higher impact resistance;

4. the present invention is simple in structure and convenient for installation.

In the figures: 1—aerosol fire extinguishing device; 2—explosion-venting device; 3—cylinder body; 4—cylinder cover component; 5—ceramic honeycomb cooling layer; 6—coolant; 7—grain; 8—ignition head; 9—sealing ring; 10—rubber plug; 11—friction layer; 12—connecting rod; 13—guiding unit; 14—limiting device; 15—guiding ring; 16—flanging; 17—clamping claw; 18—buffer; 19—heat preservation and insulation layer.

DETAILED DESCRIPTION OF THE INVENTION

Preferred embodiments of an inner cylinder of an explosion-venting-type aerosol fire extinguishing device of the present invention will be further described in combination with the accompanying drawings.

Figure 1:
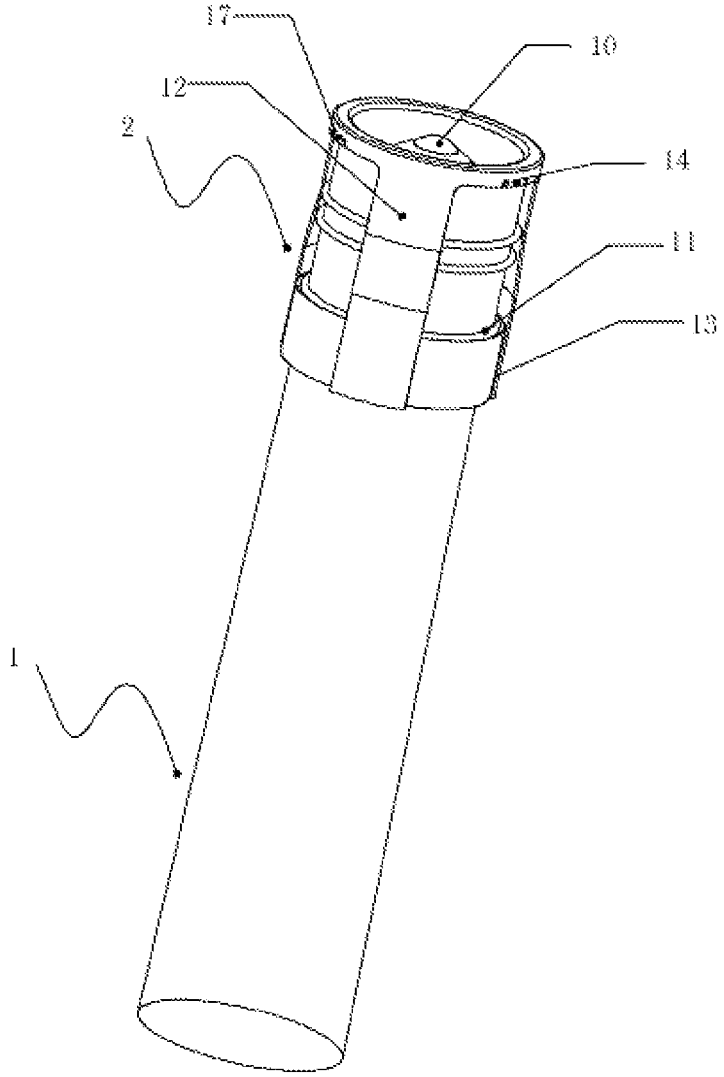
FIG. 1 is a structural diagram of an inner cylinder of the present invention.
Figure 2:
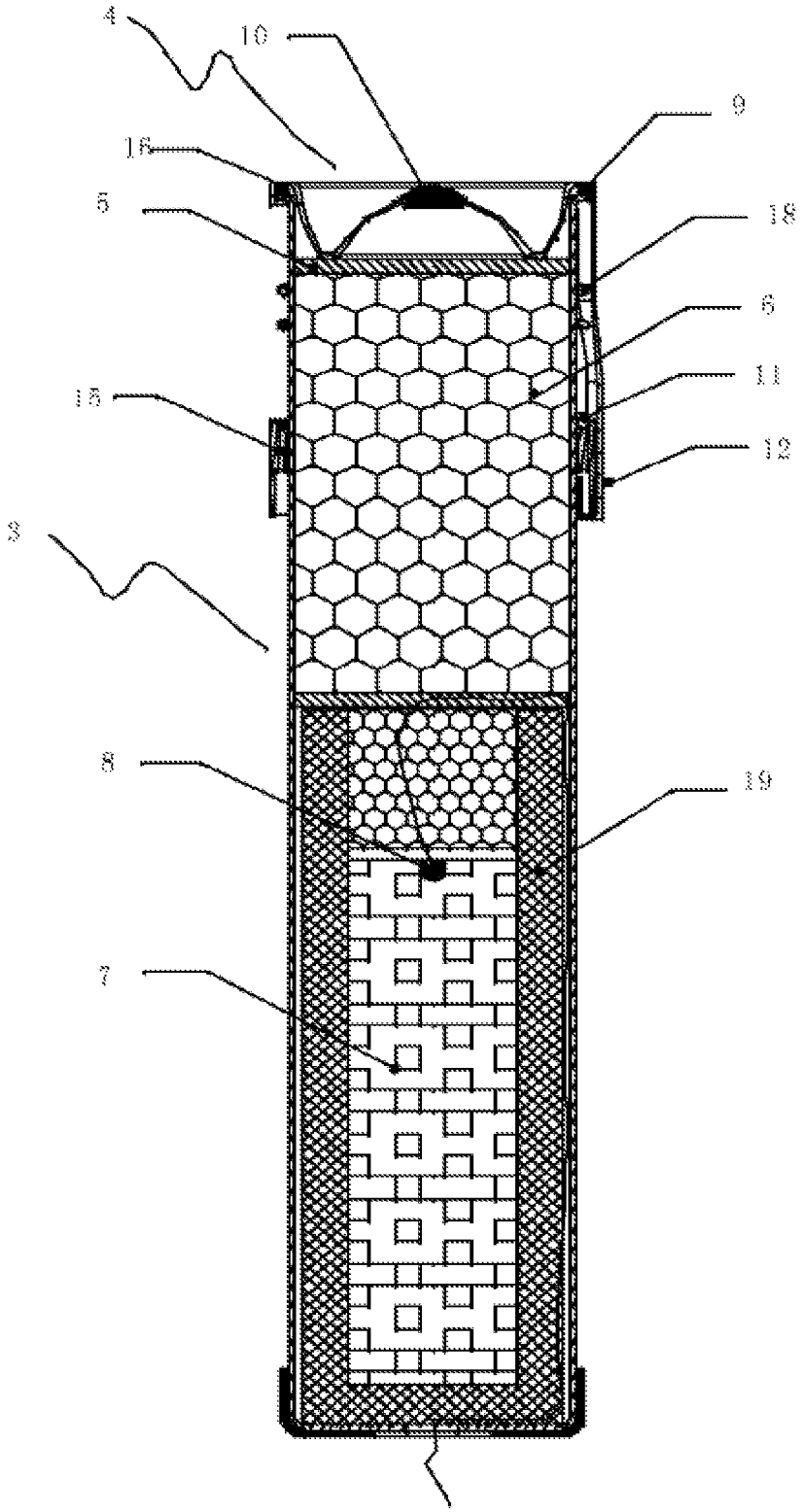
FIG. 2 is a sectional view of an inner cylinder of the present invention.

Referring to FIG. 1 and FIG. 2, the inner cylinder of the aerosol fire extinguishing device 1 of the present invention may adopt an inner cylinder with an existing structure, on which an explosion-venting device is added to solve the problem that an existing aerosol fire extinguishing device 1 fails to prevent explosion and vent pressure; or may adopt other cylinders which relates to the inner cylinders of aerosol fire extinguishing devices with explosion prevention and pressure venting requirements.

The inner cylinder of the present embodiment includes a cylinder body 3. A cylinder cover component 4 is further arranged on a top end of the cylinder body 3. A ceramic honeycomb cooling layer 5, a coolant 6, a grain 7 and an ignition head 8 arranged on a front end face of the grain 7 are arranged in the cylinder body 3 in turn. Generally, the cylinder body 3 and the cylinder cover component 4 are hermetically connected via a sealing ring 9, wherein the section of the sealing ring 9 may be square, circular, or in other shapes. The cylinder cover component 4 includes a spout and a horn nozzle, and the center of the spout directly faces the center of the horn nozzle. The spout may be sealed by a rubber plug 10 or an aluminum foil. In addition, the ceramic honeycomb cooling layer 5, on one hand, can fix the coolant 6 to prevent the coolant 6 from dropping out, on the other hand, has a physical cooling effect to cool a high temperature hot aerosol. Generally, the ceramic honeycomb cooling layer 5 may be arranged on a front end of the coolant 6, or may be also arranged in the middle of the coolant 6, or may be also arranged on both the front end and the middle of the coolant 6, and the positions and number thereof are determined according to actual application conditions. One end with a larger diameter of the horn nozzle of the present invention is connected with the honeycomb cooling layer to guide the aerosol to be spouted out from the spout, and the horn nozzle may be integrated with a cylinder cover. A heat preservation and insulation layer 19, which has a heat preservation and insulation function, may be further added between the grain 7 and an inner wall of the cylinder body 3, thus preventing heat generated after ignition of the aerosol from being dispersed to burn surrounding personnel or materials.

The explosion-venting device 2 of the present invention mainly includes a friction layer 11, a connecting rod 12, a guiding unit 13, a limiting unit 14 and a buffer 18, wherein the connecting rod 12 is connected on the cylinder cover component 4 and may be fixedly connected with the cylinder cover component 4 via welding and riveting etc., or may be directly provided as an integral structure so as to realize a higher structural strength. The friction layer 11 may be one or more rubber rings, or silica gel layers, or other materials that can provide a sufficient frictional resistance for axial sliding of the connecting rod 12. The friction layer 11 may be arranged between the connecting rod 12 and the cylinder body 3, or may be directly fixed on an inner side of the connecting rod 12. When the connecting rod 12 shifts axially along the cylinder body 3 under the guidance of the guiding unit 13, the friction layer 11 provides a frictional resistance and a buffering force for the connecting rod. The guiding unit 13 is an device that can provide guidance for the connecting rod 12 when the connecting rod 12 is moving. The guiding unit may be a guiding ring 15 fixedly connected with the connecting rod 12, or may be also a guiding groove arranged on an outer wall of the cylinder body 3 and capable of making the connecting rod 12 slide along the guiding groove, or a slide rail, or other structures with a guiding effect. The guiding structure can prevent the connecting rod 12 from being displaced or clamped during a moving process of the cylinder body 13. When a guiding ring 15 is applied for guiding, the guiding ring 15 and an extremity of the connecting rod 12 may be fixedly connected, or may be directly provided as an integral structure. The limiting device 14 of the present invention is an device that can fix the connecting rod 12 and limit the connecting rod 12 when the connecting rod 12 slides to the cylinder cover component 4. When the extremity of the connecting rod 12 reaches a position as shown of the cylinder cover component 4, the connecting rod is limited by the limiting device 14. The limiting device 14 mainly includes a flanging 16 and a clamping claw 17, wherein the flanging 16 and the cylinder body 3 are fixedly connected, or may be also directly provided as an integral structure while one end of the clamping claw 17 is fixed on the connecting rod 12 and the other end is clamped with the cylinder body 3, which is mainly used for fixing the connecting rod 12. The connecting rod 12 may be also integrated with the clamping claw 17, or the limiting device 14 of the present invention may be also other structures, which can fix the connecting rod 12 on one hand, and stop or prevent the connecting rod 12 from being separated from the cylinder body 3. The flanging 16 of the present invention may be also arranged on a lug boss of the opening of the cylinder body, and may be also integrated with a guiding groove. The structure of the flanging is determined according to an application environment. When the guiding unit 13 adopts a guiding ring 15, the buffer 18 may be further arranged between the guiding ring 15 and the flanging 16 for buffering a collision force between the guiding ring 15 or the extremity of the connecting rod 12 and the cylinder body 3 or the flanging 16 to prolong a collision duration and consume, by releasing elastic potential energy of the buffer, a part of kinetic energy generated after a deflagration.

The displacement of the connecting rod 12 of the present invention is controlled within 30 mm to 80 mm, preferably 50 mm to 60 mm, because an excessive displacement cannot reduce the recoil force. However, if the displacement is too small, the kinetic energy cannot be consumed thoroughly and the cylinder cover component is very likely to get rid of the blockage of the limiting device 14. Once the cylinder cover component is separated from the cylinder body, a powerful recoil force will be generated. However, the displacement of the connecting rod 12 may be adjusted appropriately according to a specific application environment as long as an optimal explosion venting effect can be achieved.

When the grain 7 in the inner cylinder is ignited and released normally, a hot gas is released from the spout of the cylinder cover component 4 without generating a overlarge air stream, then the explosion-venting device 2 will not be started. The connecting rod 12 is fixed on the cylinder body 3 by the clamping claw 17 and will not move axially along the cylinder body 3 to be displaced. Only when an composition is deflagrated accidentally and a powerful hot air stream pushes the cylinder cover component 4 and the connecting rod 12 to move in a direction that the hot air stream is jetting towards, the clamping claw 17 of the limiting device 14 is detached under the action of a powerful impact force on one hand, during which a part of kinetic energy of impact kinetic energy is consumed. Pushed by the hot air stream, the connecting rod 12 drives the guiding ring 15 to slide axially along the outer wall of the cylinder body 3 to be displaced. During the moving process, the friction layer 11 generates a frictional resistance on the guiding ring to consume a part of the impact kinetic energy. When the extremity of the connecting rod 12 reaches the spout of the cylinder body 3, the flanging 16 of the limiting device 14 fixed on the cylinder body 3 prevents the extremity of the connecting rod 12 from being separated from the cylinder body 3. At the moment, the buffer 18 arranged between the flanging 16 and the guiding ring 15 functions to consume a part of the impact kinetic energy with the elasticity of the buffer. In addition, the buffer buffers the powerful impact force between the extremity of the connecting rod 12 and the flanging 16. When the final kinetic energy acts, in the form of collision, on the flanging 16, the flanging 16 is distorted elastically or plastically to consume all remaining kinetic energy. Thus the powerful impact kinetic energy generated by the deflagration of the grain 7 will be consumed or dispersed in the whole process, thus avoiding injuries and damages caused by the powerful impact kinetic energy.

The inner cylinder of the present invention is not limited to the structures in the embodiments above, and is not only applicable to a portable fire extinguishing device or a fixed fire extinguishing device, but also applicable to other devices that involve the problem of pressure venting and explosion prevention.

The invention is not limited to the embodiments illustrated in the drawings. Accordingly it should be understood that where features mentioned in the appended claims are followed by reference numerals, such numerals are included solely for the purpose of enhancing the intelligibility of the claims and are in no way limiting on the scope of the claims.

What is claimed is:

1. An inner cylinder of an explosion-venting-type aerosol fire extinguishing device, comprising: a cylinder body and a cylinder cover component arranged on one end of the cylinder body, wherein an explosion-venting device is also arranged on the cylinder body; the explosion-venting device comprises:

a connecting rod, a guiding unit, and a limiting device;

the connecting rod is connected with the cylinder cover component;

the guiding unit is a device capable of providing guidance for the connecting rod when the connecting rod is moving;

the limiting device is a device capable of fixing the connecting rod and capable of limiting the connecting rod when an extremity of the connecting rod slides to the cylinder cover component;

during a process in which the cylinder cover component is separated from the limiting device and slides forwards, the original high pressure gas in the cylinder body will be dispersed or consumed rapidly because of the expansion of the outlet (venting pressure outlet);

the explosion-venting device further comprises a friction layer (11); the friction layer (11) is provided between the connecting rod (12) and the cylinder body (3); the friction layer (11) provides a frictional resistance and a buffering force for the connecting rod (12) when the connecting rod (12) is displaced, under the guidance of the guiding unit (13), along a direction towards which a hot air stream of the cylinder body (3) is jetting;

the connecting rod is fixedly connected with the cylinder cover component or integrated with the cylinder cover component;

the displacement of the connecting rod is ranged from 30 mm to 80 mm;

a spout of the cylinder cover component is sealed by a rubber plug;

a sealing ring is arranged on the junction of the cylinder cover component and the cylinder body; the section of the sealing ring is circular.

2. The inner cylinder of the explosion-venting-type aerosol fire extinguishing device according to claim 1, wherein the guiding unit is a guiding ring fixedly connected with the connecting rod, or a guiding groove provided on an outer wall of the cylinder body and capable of making the connecting rod slide axially along the guiding groove; the limiting device comprises a flanging fixedly connected with the cylinder body and a clamping claw for fixing the connecting rod; a buffer is further arranged between the flanging and the guiding ring.

3. The inner cylinder of the explosion-venting-type aerosol fire extinguishing device according to claim 2, wherein the flanging and the cylinder body are integrated.

* * * * *